United States Patent [19]

Mayer et al.

[11] 4,436,430

[45] Mar. 13, 1984

[54] DEVICE FOR THE CONTINUOUS MIXING OF A DRY FINISHED MORTAR

[76] Inventors: Karl M. Mayer, Immenhofen 55, 8951 Ruderatshofen; Rudolf Schäfer, Blaichacher Str. 21, 8971 Burgberg, both of Fed. Rep. of Germany

[21] Appl. No.: 377,168

[22] Filed: May 11, 1982

Related U.S. Application Data

[63] Continuation of Ser. No. 149,695, May 14, 1980, abandoned.

[30] Foreign Application Priority Data

May 17, 1979 [DE] Fed. Rep. of Germany ..... 2920025

[51] Int. Cl.³ ..... B28C 5/08; B28C 5/16

[52] U.S. Cl. ..... 366/13; 366/15; 366/20; 366/40; 366/65; 366/98; 366/168; 366/191; 366/194; 366/317; 366/325; 366/329

[58] Field of Search ..... 366/2, 3, 5, 15, 10, 366/13, 16, 65–67, 76, 91, 185, 97, 98, 167, 155, 168, 139, 154, 163, 191, 194, 172–174, 177, 179, 293, 295, 316, 317, 20, 40, 325, 329

[56] References Cited

U.S. PATENT DOCUMENTS

| | | | |
|---|---|---|---|
| 2,847,195 | 8/1958 | Bean | 366/191 |
| 3,423,075 | 1/1969 | Knudsen et al. | 366/317 |
| 3,502,305 | 3/1970 | Grun | 366/317 |
| 3,936,037 | 2/1976 | Leonard | 366/191 |
| 4,112,517 | 9/1978 | Giombini | 366/168 |
| 4,254,699 | 3/1981 | Skinner et al. | 366/316 |
| 4,277,183 | 7/1981 | Shinriki | 366/98 |

*Primary Examiner*—Timothy F. Simone

*Attorney, Agent, or Firm*—Cushman, Darby & Cushman

[57] ABSTRACT

A device for mixing mortar with a liquid or foaming material includes a reservoir for the dry mortar, a housing containing a portion of a driven shaft with the housing terminating at one end in a mixing chamber; the mixing chamber contains a disc attached to the shaft and rotatable therewith; on one side of the disc, there is located radially extending mixing paddles or blades, the outer edges of the blades and the discs being spaced a predetermined distance to define a gap between the inner surface of the wall of the mixing chamber and the outer edge of the blades and disc; at one end of the mixing chamber an outlet is provided which is connected to a suction device and a baffle ring is situated about the outlet to divert material away from the suction inlet.

10 Claims, 3 Drawing Figures

DEVICE FOR THE CONTINUOUS MIXING OF A DRY FINISHED MORTAR

This is a continuation, of application Ser. No. 149,695 filed May 14, 1980, abandoned.

The invention on the one hand relates to a method of continuously mixing a coarse-grained to powdery dry finished mortar, for example mortar for plastering and masonry mortar, with a liquid and/or a foamy material in a mixing chamber in advance of which is arranged a reservoir for the dry material and after which is arranged a suction device for the mixed material, and on the other hand relates to a device for carrying out this method.

The German Utility Model No. 7,046,623 has made known a device for carrying out this method. The dry material advanced from a reservoir by means of a worm conveyor falls into a vertical mixer tube in which is rotating a dry material stripper and after which is arranged a feed pump. Since the conveying device for the dry material and the mixing device are driven by two separate engines, the mixing device can fully be emptied independent of the dry material to be fed thereafter. The mixed material leaving the mixing device contains only a relatively small proportion of air voids, this resulting in the disadvantages stated hereinafter. Lime cement plasters and cement plasters, when having been applied onto the surface to be plastered, tend for forming drying cracks which can already occur after a few minutes or hours. Moreover, after some time, there is the danger that tension cracks are formed. If conventional plasters are used, these dangers are minimized by applying the plaster in several layers. It has also turned out that coarse-grained sands diminish the tendency to form cracks in the plaster. The commonly used plastering method however has been quite time and work consuming.

Therefore, one has developed the so-called one-layer plasters which can be processed also by continuous blenders. In order to ensure that the machine works satisfactorily, however, the grain-size of these materials had to be reduced to 1–1.5 mm.

In order to make possible the one-layer processing of these plasters, one had to add chemicals for the formation of air voids and for water retention. Though there have been achieved good results in case of compulsory mixers for batch processes, in case of the commercial continuous blenders (for example the German Utility Model No. 7,046,623) the material has been mixed too short a time. Only a few air voids were brought in and the tendency of forming cracks in the plasters was considerably increased thereby.

The invention has been based on the problem to provide a method and a device by which it is possible to process plasters or mortars which are particularly rich in air voids.

The problem is solved by a method of the type as initially mentioned by inventively blocking the mixing chamber by means of a mechanical device in co-operation with the dry material against discharge of air by the dry material supply, by furthermore keeping the mixing chamber filled partly with the dry material among which is permeated the air cushion while being under a slight overpressure and partly with the mixed material, and by re-feeding an amount of dry material which is at least as large as the amount of the mixed material removed by the suction device. Whereas when worm conveyors or similar compulsory conveyors are used, the content of air in the plaster is even reduced, the devices of the German Offenlegungsschrift No. 2,117,000 and 2,437,231 have not led to any tangible result either since on the one hand the supply of the water into the region of the worm drive and on the other hand even the agitator arranged after the feed pump could not prevent that the dry material was supplied to the mixing device in a form where it is poor in air voids. It is therefore not possible with the use of this device to obtain a building material that is enriched with air voids, either. According to the invention, it is therefore in addition suggested to feed the liquid and/or the foamy material under pressure into the interior of the mixing chamber so that it is finely distributed in the whole mixing chamber. Since in case of the inventive method no compulsory conveyors are to be used but the starting materials are already in a dry state and enriched with air supplied to the mixing chamber, the finely divided sprinkling or drizzling of the dry mass provides an additional possibility to increase the porosity of the final product or at least not to decrease its porosity.

According to an especially preferred measure, the dry material and/or material to be mixed is processed in compartments separated in the mixing chamber by partition walls, said compartments being interconnected by calibrated slits, gaps, bores or the like, and there being passed through the latter ones only such an amount of dry material and/or material to be mixed as is removed from the suction device. The stepwise treatment of the dry material while simultaneously preventing to a great extent the degassing thereof results in end products which contain many voids.

Whereas in case of the known methods the material to be mixed stays in the mixer tube for ab out 5 to 6 seconds, according to the invention the dry material or material to be mixed is to be treated in the mixing chamber at least for 10 seconds. The void content of the end product is also increased thereby.

What is finally achieved by the inventive method is that the material to be mixed by mxing gains a relative increase of air void content of more than 8%, preferably more than 20%.

By the use of the inventive method and the increase of the air void content, the gross density of the final product or plaster is reduced and thus the heat insulation is improved; the water vapour diffusion capacity is considerably increased; drying on the wall surface takes place more rapidly; in addition, possibly occuring condensed water can more easily evaporate in the wall. In case of wet mortar for plastering, the water retention capacity is improved since the air voids interrupt the void channels; therefore, cracks caused by drying are not so rapidly produced and the binders have for a longer time at disposal the water required for cementation. Working with the plaster is facilitated since the air voids give it a more "creamy" consistency; the plaster thus becomes more "malleable". The capability of being passed through the machine, i.e. the capability of the final product of being pumped, is improved since the small voids like "ball bearings" reduce the friction on the wall; it is made possible thereby either to further convey the final product by means of a pump or to reduce the wear of the pump by pressure reduction. The introduced increased air void content results in an improvement of the productivity per unit of weight of the final product, i.e. one needs only the same amount of material for plastering more square meters. It has to be pointed out in this connection that though when machines are used which operate with batches—as mentioned above—, one strives for an air void content of 20–25% in the lime cement plasters currently on the market, this is rarely achieved exactly and uniformly since naturally the mixing times vary considerably on the building site. In case of continuously operating plastering machines where mono-worms are used, there is achieved an air void introduction, for example in a lime cement plaster, of only 7 to 10%, whereas by means of the inventive device one can achieve an air void content of about 25% and more.

The device suggested for carrying out the inventive method is substantially characterized in that according to the invention there is provided between the reservoir and the mixing chamber at least one retaining room which is filled with dry material and air cushions and which through calibrated slits, bores or the like is connected, on the one hand, to the reservoir and, on the other hand, to the mixing chamber.

The slits, bores or the like can have a size which just exceeds that of the coarse grain of the dry material.

The inventive device is in principle constructed like the corresponding device of the German Utility Model No. 7,046,623, i.e. the mixing chamber, which is provided with an approximately vertical driving shaft and includes a cylindrical feed room, is connected at one face of the substantially horizontal reservoir, however, according to the invention the mixing chamber is enlarged in radial direction relative to the cylindrical feed room and is closed substantially airtight.

This construction of the inventive device provides for a space-saving mixing chamber where connection to known similar mixer tubes is possible and by which the air void content of the final product can decisively be increased.

One can provide in the interior of the mixing chamber a feed line for the liquid and/or the foamy material where the outlet openings of said feed line are distributed over the whole mixing chamber. Onecan introduce into the dry material also steam—i.e. a gaseous medium—instead of the mentioned liquid.

According to a preferred embodiment of the inventive device, the feed line is annular and consists of a tube which is provided with bores, slits or the like. The intensive treatment of the material and the annular shape of the feed line result in that also the wear in the mixing chamber is reduced. The annular feed line for the liquid and/or the foamy material in the mixing chamber can be separated from the dry material supply by a stationary cylindrical deflector or the like. It is also possible that the stirring apparatus of the mixing chamber is mounted on a shaft end which is detachably connected to the coaxial driving shaft e.g. via a plug clutch. The cylindrical feed room provided above the retaining room is in a useful manner at least at its end pointing towards the retaining room provided with beaters and/or knifes; the beaters and/or knifes can be provided at least directly above the calibrated slits, gaps, bores or the like which lead to the retaining room.

For letting through the dry material into the retaining room, one has preferably provided an annular slit surrounding a jacket of the driving shaft; for passing the dry material from the retaining room to the mixing chamber, one has usefully arranged an annular slit or the like between a stationary case wall surrounding the driving shaft in spaced relationship and a rotary disk/or the like which can be provided with beaters.

The said retaining room between the reservoir and the mixing chamber is produced as a result of the fact that the dry material, which falls e.g. only by its own gravity through the small calibrated openings or slits, forms above the slits by the dry material conveyed from the reservoir a barrier so that air cannot be removed from the dry material which passes through in a free fall and contains substantially air. That is to say, there are formed in the retaining room standing air cushions or air bubbles which are exposed to slight pressure and cannot escape upwardly and therefore are carried forward by the further dry material falling down at the edge of the rotary disk and are supplied to the mixing chamber.

The stirring apparatus provided in the mixing chamber can have beaters or the like which are mounted on a rotary disk or the like extending across the mixing chamber and separated from the wall of the mixing chamber, which wall is parallel to the axis of rotation, by an annular slit. At the edge of the rotary disk supporting the stirring apparatus, there are provided pins, plates or the like which extend preferably parallel to the wall of the mixing chamber. These pins, plates or the like convey the pulpy and already wet mixed material to the said annular slit and along the wall of the mixing chamber in the direction towards the suction opening. It is furthermore possible that the rotary disk or the like supporting the stirring apparatus is provided with small bores, holes or the like for sucking air; these bores, holes or the like are arranged at a distance from the wall of the mixing chamber case which corresponds to one third of the beater length approximately.

At the lower side of the rotary disk supporting the stirring apparatus, there can be provided plates, pins, knifes or the like which are arranged parallel to the axis of rotation. Also, the bottom wall joined to the mixing chamber wall can have a truncated cone shape and the central portion of the bottom wall can extend vertically to the axis of rotation; the portion of the bottom wall extending vertically to the axis of rotation can support a ring or the like being in the form of a baffle plate for the mixed material, the upper edge of said baffle plate projecting over the lower edge of the plates, pins, knifes or the like. The said baffle plate together with the plates, pins, knifes or the like effects a further mixing effect; moreover, as a result of the whirling or whirlpool effect achieved at the outlet by the suction device, there is incorporated into the material to be mixed the air sucked through the small bores or holes so that at this location also the air void content is increased.

The shaft end carrying the stirring apparatus can be provided at its lower end with an adapter for a clutch of the suction device, and an annular slit or the like for sucking the mixed material can be arranged between the clutch and the rectilinear portion of the bottom wall.

It is also possible that the upper wall of the mixing chamber is secured to the case wall surrounding the cylindrical feed room and either a hinge or the like for letting down the mixing chamber is provided on said upper wall or the mixing chamber is detachably arranged on the upper wall.

Finally, the beaters mounted on the rotary disk or the like can with their inner edges be secured to a cylinder surrounding in spaced relationship the shaft end and carrying the rotary disk or the like defining the retaining room.

The drawing shows an exemplifying embodiment of the inventive device;

Figure 1:
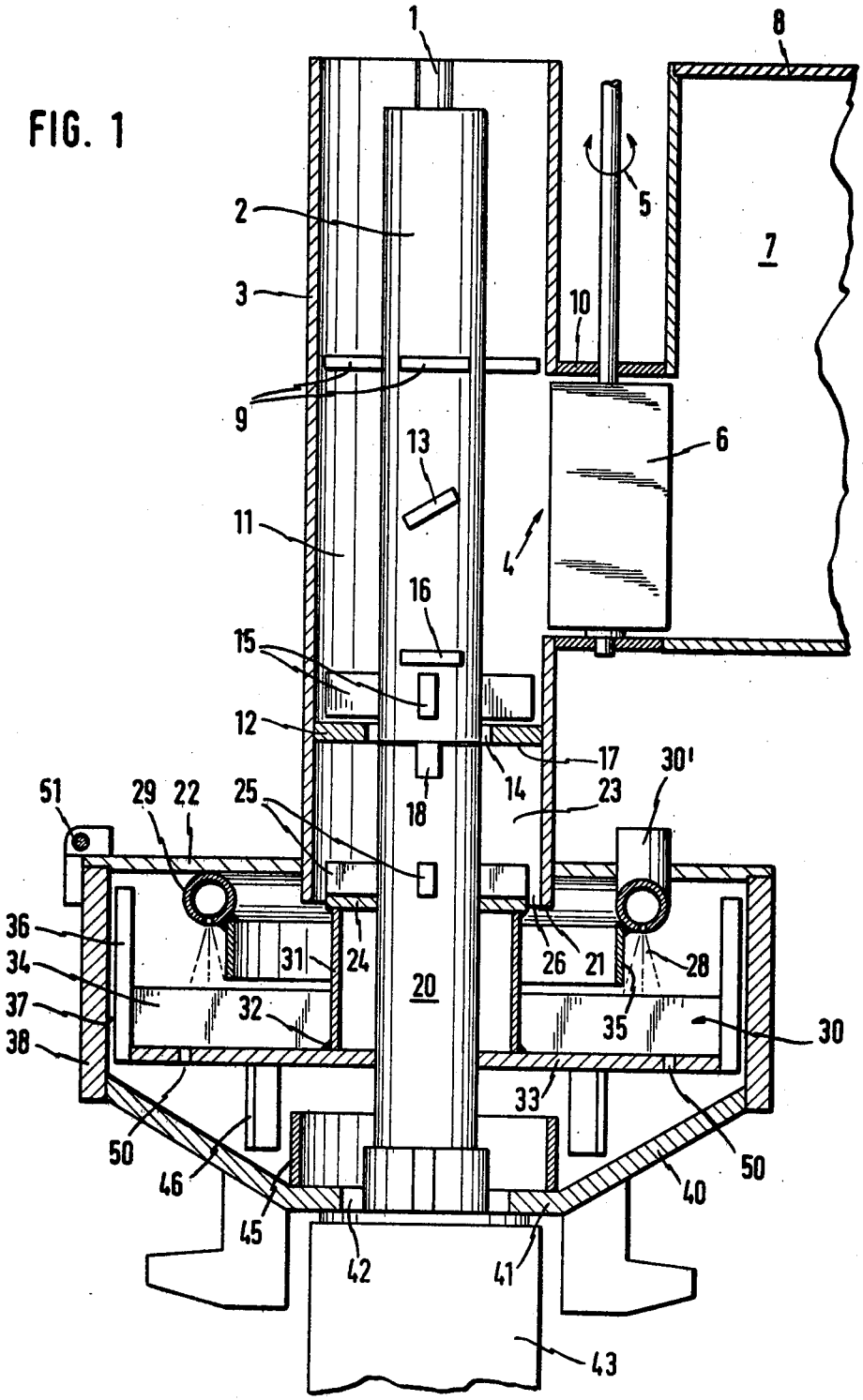
FIG. 1 is a longitudinal section through the embodiment.

A shaft 1 of an electromotively driven stirring apparatus is provided with a case 2 and is accomodated in the center of a cylindrical housing 3. The cylindrical housing 3 extends to the electromotor (not shown) and has a lateral break 4 which is provided with a throttle valve 6 turnable in the direction of the arrow 5 and which leads to a reservoir 7 whose worm drive is not shown; the reservoir 7 can be provided with a cover 8.

Dry material is conveyed through the break 4 into the housing 3.

Figure 2:
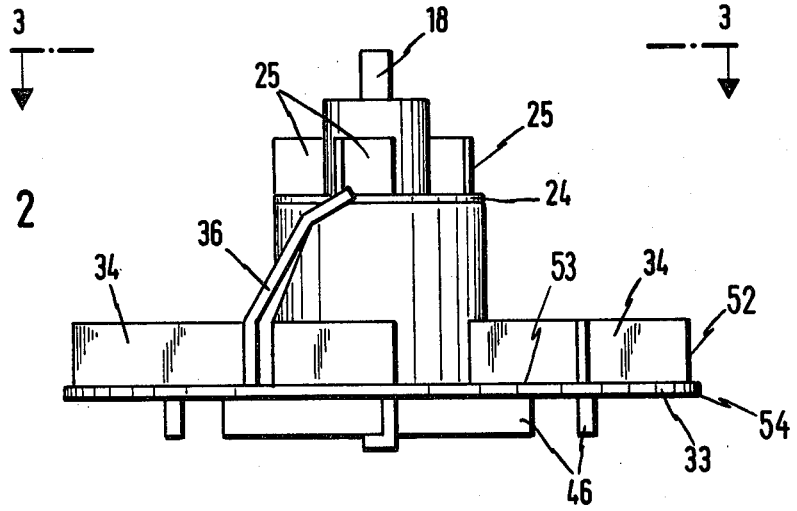
FIG. 2 shows a detail of this embodiment.

Knife-shaped blades 9 are mounted to the case 2 of shaft 1, and they "close" the space in the housing 3 at the upper edge 10 of the break 4. The space 11 which is nearly completely filled with dry material is closed at its lower side by a wall 12 which in case of need can also be exchangeable. The blades or beaters 13 cause a "retaining" of the dry material in the direction towards the lower end of the shaft 1. Around the case 2, there is provided at the level of the wall 12 an annular gap or annular slit 14 by which is performed apportioning of the dry material in the mixing device. Directly above the annular gap, there are attached to the case 2 beaters 15 which can also be crossed such that they continuously feed dry material towards the bottom. There can be provided above the beaters 15 knife-like blades 16 which can also in certain circumstances be mounted in inclined position—like the blades 13 at the case 2—and which retain the dry material in the direction to the mixing device. As can be seen from FIGS. 1 and 2, the case 2 terminates at the level of the lower edge 17 of the wall 12 and can in a torsionproof manner be connected to a shaft end 20 for example by means of a plug-connection 18.

The cylindrical housing wall 3 has above its lower edge 21 a radially extending upper wall 22 which for example is welded together with the wall 3 or is firmly connected thereto in another way.

Beneath the wall 12, there is provided a retaining room 23 whose lower end is formed by a disk or a plate 24 on which are mounted blades 25 which can be crossed such that they force the dry material towards the blades 15. The disk 24 leaves free an annular gap 26 which is provided between the housing wall 3 and the said disk.

Due to the fact that the dry material is deposited in the space 11 as far as to fill up always the space above the wall 12 or also above the beaters 15 and the knife-like blades 16 with dry material, only a desired metered amount of dry material is conveyed through the annular slit 14 as a result of a rotation of the stirring shaft 1.

Since the annular slit 26 has a greater diameter than the annular slit 14, the dry material can more rapidly and better fall through the annular slit 26 than through the annular slit 14. Since, however, on the other hand the beaters 25 can also be crossed such that the dry material is forced into the retaining room 23, there are produced above the dry material lying in the room 23 air bubbles or air cushions which are exposed to slight overpressure; said air bubbles or air cushions due to the course of the dry material in the direction toward the mixing chamber 30 provide for an especially intensive aeration of the dry material in the mixing chamber. The disk 24 is mounted on a cylindrical pipe portion 31 at whose lower edge 32 is secured an additional disk 33 having a face 53 and an outer edge 54. As can be seen from FIG. 3, five beaters 34 each having a free outer edge 52 are mounted on the disk 33, said beaters performing mixing of the downwardly trickling dry material with a liquid, e.g. water 28. The liquid is supplied through a tube ring 29 to which it is fed under pressure through an inlet connection pipe 30'. In order to prevent the liquid from penetrating the dry material already in the vicinity of the annular gap 26, there is provided in the mixing chamber a shielding ring 35 which is welded together with the tube ring 29. What is achieved thereby is that the dry material while being still in its dry state falls into the mixing chamber provided with beaters 34. The beaters 34 can be crossed so as to cause conveying of the material outwardly in radial direction and simultaneously upwardly.

Figure 3:
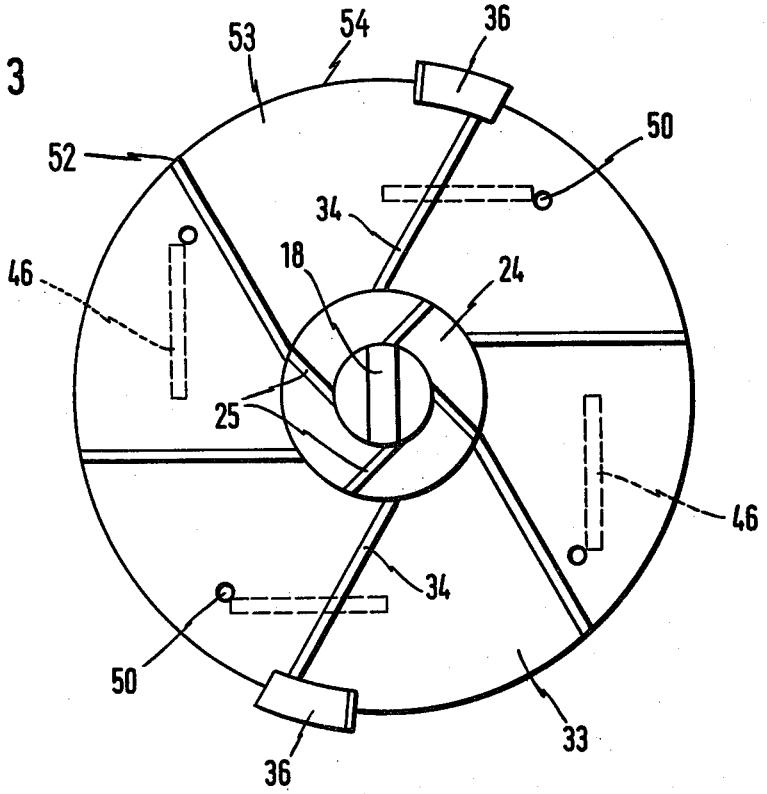
FIG. 3 is a view taken along the line 3—3 in FIG. 2.

As can be seen from FIG. 3, at the end of two beaters 34, there are attached strippers 36 which leave free the annular gap 37 to the cylindrical outer wall 38 of the mixing device. These strippers can have the shape shown in FIG. 3, i.e. they can be bent such that they force the material to be mixed—which here is already completely wet through—again in the direction toward the stirring beaters 34.

On rotation of the stirring shaft 1 and thus of the case 2 as well as of the shaft end 20, the stirring beaters 34 as well as the blades 25 are caused to rotate. The tubular shield 35 is stationary and prevents the wet mixed material from being forced upwardly. The mixed material which is laterally forced down in the annular slit 37 runs runs along a conical wall 40 in the direction toward the stirring shaft 1 or the shaft end 20. The portion 41 of the wall 40 extending rectangularly to the stirring shaft axis is provided with an annular slit 42 through which the prepared mixed material is sucked into a suction device 43 or is sucked therefrom by a feed pump provided in a conduit.

At the location between the rectilinear portion 41 and the conical portion 40 of the bottom wall, there is provided a cylindrical shielding wall 45; while being spaced from this cylindrical wall, during operation of the stirring apparatus the pins, plates 46 or the like rotate so that yet in this region an additional mixing effect is achieved.

As can best be seen from FIG. 3, there are provided in the disk 33 bores 50 through which the air present in the region of the stirring apparatus can be sucked in the direction toward the suction device 43. Since in the region of the annular slit 42 swirls or whirlpools are produced by the rotation of the stirring apparatus and by the movement caused by the feed pump or from the mixing device, the air sucked through the bores 50 is brought into the material to be mixed so that the void content thereof is more increased.

The time during which the dry material passing through the slit 14 is staying in the mixing device until the mixed material leaves it through the annular slit 42 is for example about 20 to 30 seconds, and not only the mixing effect but also the void content is decisively increased thereby, it being possible to increase said void content up to 25%. Due to the fact that the stirring beaters 34 convey the material to be mixed as a result of their inclination mainly in upward direction and that the material can only through the annular channel 37 "in a pulpy state" flow off, there are produced accumulations of the dry material not only in the mixing chamber but also above the annular gap 26 mainly in the retaining room 23. Accordingly, said retaining room 23 contains, in addition to the dry material, also air bubbles or air cushions which, as has already been stated, are exposed to a slight air pressure of a few tenths. This air is then supplied to the dry material in the mixing chamber and incorporated into the material to be mixed.

The increase of the air void content turns out to be particularly useful with fine grained or fine plaster types such as lime cement plasters or cement plasters which in inside rooms or outside rooms can mechanically applied in one layer.

Whereas the upper wall 22 is secured to the housing 3, there is provided a hinge 51 for letting down the mixing device for example for cleaning purposes.

By the inventive mixing method or the inventive mixing device, the air void content in all those dry finished mortars can be increased where the air void content can also be increased when charge mixers including an accordingly long staying time are used. In comparison with the use of mixer tubes—i.e. continuous mixing devices—however, decisive improvements can be achieved. For example, in case of a lime gypsum plaster where a conventional mixer tube is used, one can achieve an air void content of only 7 to 10% as compared with 15 to 20% achieved by the use of the inventive device; the corresponding values in case of a lime cement plaster are 7 to 12% as compared with 20 to 25%. In case of a known heat insulating plaster, the values are 25 to 30% in comparison with 45 to 50%. The resistance to frost of the plaster is also improved by the increased air void content. The longer mixing time furthermore results in that all the admixtures of the dry finished mortar have at disposal a longer time for dissolving and thus their effect is more fully developed.

We claim:

1. In a device for the continuous mixing of a powdery, dry mortar with a liquid and/or foam material, wherein said device includes a cylindrical mixing chamber having a circumferential wall and an outlet connected to a suction device and an axially disposed, motor-driven mixing shaft having mixing means, the improvement comprising said mixing chamber including a disc member surrounding said shaft and rotatable therewith, said disc member extending substantially perpendicular to said shaft and having on a face thereof opposite said outlet said mixing means, said mixing means comprising a plurality of generally upstanding and radially extending beaters being secured on said face of said disc member, each said beater having a free outer edge, said free outer edges of said beaters and outer edge of said disc member being spaced from said mixing chamber wall to define an annular gap having a width just exceeding the largest grain diameter of the dry mortar, said mixing chamber comprising further an annular liquid supply member surrounding and radially spaced apart from said mixing shaft, and said mixing chamber including furthermore baffle means for diverting the material being mixed from said suction device.

2. The device as claimed in claim 1 wherein a cylindrical supply chamber is provided for supplying dry mortar to said mixing chamber through another narrow annular gap.

3. The device as claimed in claim 2 wherein a dry material storage container is provided which is connected to said supply chamber through a third narrow annular gap.

4. The device as claimed in claims 2 or 3 wherein said supply chamber concentrically surrounds said mixing shaft.

5. The device as claimed in claim 1 wherein said mixing chamber includes a cylindrical separating ring disposed between the dry material and said liquid supply member, said liquid supply member being in the form of a partially annular tube.

6. The device as claimed in claim 1 wherein said outlet of said mixing chamber is provided in the form of an annular gap disposed about said shaft and which leads to said suction device.

7. The device as claimed in claim 6 wherein said baffle means is in the form of a shielding ring surrounding said annular gap on the interior of said mixing chamber, said annular ring having one side edge attached to said mixing chamber wall.

8. The device as claimed in claim 7 wherein both said mixing chamber and supply chamber are circular in cross-section and said mixing chamber wall has a radius that is substantially greater than that of the radius of said supply chamber.

9. In a device for the continuous mixing of a powdery dry mortar with a liquid and/or foam material, said device including a cylindrical mixing chamber including a circumferential wall and an outlet connected to a suction device and an axially disposed, motor-driven mixing shaft having mixing means, the improvement comprising said mixing chamber including a disc member surrounding said shaft and rotatable therewith, said disc member extending substantially perpendicular to said shaft and having on a face thereof opposite said outlet said mixing means, said mixing means comprising a plurality of generally upstanding and radially extending beaters being secured on said face of said disc member, each said beater having a free outer edge, said free outer edges of said beaters and outer edge of said disc member being spaced from said mixing chamber wall to define an annular gap having a width just exceeding the largest grain diameter of the dry mortar, said mixing chamber comprising further an annular liquid supply member surrounding and radially spaced apart from said mixing shaft, said mixing chamber including furthermore baffle means for diverting the material being mixed from said suction device, said disc member having blades secured to the side thereof facing said outlet.

10. The device as claimed in claim 9 wherein stripper means are secured to the side of said disc member facing away from said outlet adjacent the outer edge of said disc member.

* * * * *